US007677184B2

(12) United States Patent
Dhanoa et al.

(10) Patent No.: US 7,677,184 B2
(45) Date of Patent: Mar. 16, 2010

(54) FLIP TOP TABLE

(75) Inventors: David S. Dhanoa, Kentwood, MI (US); Francisco J. Olvera, Kentwood, MI (US)

(73) Assignee: Steelcase Development Corporation, Grand Rapids, MI (US)

( * ) Notice: Subject to any disclaimer, the term of this patent is extended or adjusted under 35 U.S.C. 154(b) by 1008 days.

(21) Appl. No.: 11/304,467

(22) Filed: Dec. 15, 2005

(65) Prior Publication Data

US 2007/0137534 A1 Jun. 21, 2007

(51) Int. Cl.
*A47B 3/00* (2006.01)

(52) U.S. Cl. ..... 108/115

(58) Field of Classification Search ..... 248/188.1, 248/188.6; 108/115, 125, 129, 131–133
See application file for complete search history.

(56) References Cited

U.S. PATENT DOCUMENTS

| | | | | |
|---|---|---|---|---|
| 275,598 | A | 4/1883 | Crandall | |
| 331,149 | A | 11/1885 | McClure | |
| 346,795 | A | 8/1886 | Wilcox | |
| 355,230 | A | 12/1886 | Taliaferro | |
| 409,544 | A | 8/1889 | Zeigler | |
| 571,980 | A | 11/1896 | Penfield | |
| 598,077 | A | 2/1898 | Comee | |
| 874,052 | A | 12/1907 | Cantwell | |
| 881,556 | A | 3/1908 | Dehler | |
| 948,905 | A | 2/1910 | Snyder | |
| 1,083,146 | A * | 12/1913 | Schartz | 108/13 |
| 1,200,071 | A | 10/1916 | Barler | |

(Continued)

FOREIGN PATENT DOCUMENTS

| | | |
|---|---|---|
| EP | 0 392 817 | 10/1990 |

(Continued)

OTHER PUBLICATIONS

Versteel, "TIM (Tables In Motion)," 5 page printout from web site, 2001.

(Continued)

*Primary Examiner*—Janet M Wilkens
(74) *Attorney, Agent, or Firm*—Quarles & Brady LLP

(57) ABSTRACT

A flip top table assembly including a table top member having an undersurface, a leg member having a top end, a hinge linking the top member to the top end of the leg member for pivotal movement between a substantially horizontal position and a substantially vertical position, a restrainer forming at least first and second openings and forming an edge, a slider forming at least first and second distal pin ends, the slider supported by one of the table top member and the leg member proximate the restraining member and at least a first spring biasing the slider toward the restraining member where, when the top member is in the horizontal position, the first pin end is aligned with the first opening and is biased by the spring toward a restraining position and, when the top member is in the vertical position, the second pin end is aligned with the second opening and is biased by the spring toward a restraining position received within the second opening and the first pin end is biased by the spring toward a space adjacent the edge of the restraining member outside the first and second openings.

30 Claims, 10 Drawing Sheets

U.S. PATENT DOCUMENTS

| | | | | | |
|---|---|---|---|---|---|
| 1,341,988 | A | | 6/1920 | Koechlin | |
| 1,735,162 | A | | 11/1929 | Favour | |
| 1,872,849 | A | | 8/1932 | Townes | |
| 1,912,096 | A | | 5/1933 | Reuter | |
| 1,939,459 | A | | 12/1933 | Murray | |
| 1,981,052 | A | | 11/1934 | Lehner | |
| 2,174,952 | A | | 10/1939 | Spikings, Jr. | |
| 2,397,405 | A | | 3/1946 | Burkeman | |
| 2,520,469 | A | | 8/1950 | Mowrev | |
| 2,714,543 | A | * | 8/1955 | Hosler | 108/115 |
| 2,739,860 | A | | 3/1956 | Wilson | |
| 2,741,868 | A | | 4/1956 | Saunders | |
| 2,771,937 | A | | 11/1956 | Wilson | |
| 2,791,477 | A | | 5/1957 | Wesbecher | |
| 3,183,860 | A | * | 5/1965 | Kritske | 108/2 |
| 3,188,158 | A | | 6/1965 | Sanchez | |
| 3,217,673 | A | | 11/1965 | Knoblock | |
| 3,276,401 | A | | 10/1966 | Wilson et al. | |
| 3,543,312 | A | | 12/1970 | Pofferi | |
| 3,598,390 | A | | 8/1971 | Armitage | |
| 3,618,704 | A | | 11/1971 | Smith, Sr. | |
| 3,641,946 | A | * | 2/1972 | Charnay | 108/6 |
| 3,696,762 | A | | 10/1972 | Holdham | |
| 3,785,299 | A | | 1/1974 | Caperton, Jr. | |
| 3,786,766 | A | | 1/1974 | Chiariello | |
| 3,796,169 | A | | 3/1974 | Bales et al. | |
| 3,805,710 | A | | 4/1974 | Leshem | |
| 3,861,325 | A | | 1/1975 | Bue et al. | |
| 3,903,812 | A | | 9/1975 | Cowley | |
| 3,951,233 | A | | 4/1976 | Meyers | |
| 3,993,004 | A | | 11/1976 | Alme | |
| 4,097,037 | A | | 6/1978 | Tardiff | |
| 4,099,469 | A | | 7/1978 | Sahli | |
| 4,108,083 | A | | 8/1978 | Espinosa | |
| 4,136,622 | A | | 1/1979 | Bue et al. | |
| 4,191,111 | A | | 3/1980 | Emmert | |
| 4,196,675 | A | | 4/1980 | Cook | |
| 4,305,581 | A | | 12/1981 | Neuharth | |
| 4,350,098 | A | * | 9/1982 | Shirono et al. | 108/6 |
| 4,372,631 | A | | 2/1983 | Leon | |
| 4,383,486 | A | | 5/1983 | Reineman et al. | |
| 4,387,650 | A | | 6/1983 | Pizzi | |
| 4,643,105 | A | | 2/1987 | Baum | |
| 4,645,162 | A | | 2/1987 | Roy et al. | |
| 4,754,844 | A | | 7/1988 | Sutton | |
| 4,773,337 | A | | 9/1988 | Ball | |
| 4,815,395 | A | | 3/1989 | Trueg | |
| 4,848,243 | A | | 7/1989 | Giordano | |
| 4,879,954 | A | | 11/1989 | Sawamura et al. | |
| 4,943,040 | A | * | 7/1990 | Finstad et al. | 269/69 |
| 4,967,877 | A | | 11/1990 | Wallman et al. | |
| 4,986,195 | A | | 1/1991 | Diffrient | |
| 4,986,501 | A | | 1/1991 | Simon | |
| 5,056,780 | A | | 10/1991 | Tsang | |
| 5,058,965 | A | | 10/1991 | Thorn | |
| 5,117,986 | A | | 6/1992 | Lin | |
| 5,119,903 | A | | 6/1992 | Ulshafer, Jr. | |
| 5,121,697 | A | | 6/1992 | Baum et al. | |
| 5,131,333 | A | | 7/1992 | Karasawa et al. | |
| 5,154,127 | A | | 10/1992 | Booth | |
| 5,161,766 | A | | 11/1992 | Arima | |
| 5,174,225 | A | | 12/1992 | Reise et al. | |
| 5,197,393 | A | | 3/1993 | Yeakle | |
| 5,205,223 | A | | 4/1993 | Ball et al. | |
| 5,337,657 | A | | 8/1994 | Diffrient | |
| 5,354,027 | A | | 10/1994 | Cox | |
| 5,445,085 | A | | 8/1995 | Westerburgen | |
| 5,528,997 | A | | 6/1996 | Miller | |
| 5,657,703 | A | | 8/1997 | Johnson | |
| 5,746,660 | A | | 5/1998 | Grover | |
| 5,765,911 | A | | 6/1998 | Sorenson | |
| 5,865,124 | A | | 2/1999 | Wroe | |
| 5,927,214 | A | | 7/1999 | Schwartz et al. | |
| 6,070,367 | A | | 6/2000 | Wagner et al. | |
| 6,082,271 | A | | 7/2000 | Gosselin et al. | |
| 6,085,669 | A | | 7/2000 | Marchand et al. | |
| 6,119,605 | A | | 9/2000 | Agee | |
| 6,145,800 | A | * | 11/2000 | Watkins | 248/461 |
| 6,164,217 | A | | 12/2000 | Prendergast | |
| 6,170,407 | B1 | | 1/2001 | Hayward | |
| 6,192,808 | B1 | | 2/2001 | Bue | |
| 6,314,892 | B1 | | 11/2001 | Favini | |
| 6,336,414 | B1 | | 1/2002 | Stewart et al. | |
| 6,354,227 | B1 | | 3/2002 | Feldpausch | |
| 6,425,567 | B2 | | 7/2002 | Schutze | |
| 6,550,405 | B2 | | 4/2003 | Gosselin | |
| 6,553,918 | B2 | | 4/2003 | Bieza | |
| 6,564,903 | B2 | | 5/2003 | Krajec | |
| 6,575,103 | B1 | | 6/2003 | Holdredge et al. | |
| 6,637,352 | B1 | | 10/2003 | Thode et al. | |
| 6,662,731 | B2 | | 12/2003 | Teppo et al. | |
| 6,681,704 | B1 | | 1/2004 | Brookhiser | |
| 6,817,303 | B2 | | 11/2004 | Gosselin | |
| 6,845,723 | B2 | | 1/2005 | Kottman et al. | |
| 2003/0173472 | A1 | | 9/2003 | Liu | |
| 2005/0039642 | A1 | | 2/2005 | Cornelius | |
| 2005/0235886 | A1 | | 10/2005 | Koning et al. | |
| 2006/0075943 | A1 | * | 4/2006 | Chen et al. | 108/115 |
| 2007/0039524 | A1 | * | 2/2007 | Pearson | 108/116 |
| 2007/0209559 | A1 | * | 9/2007 | Mockel | 108/115 |

FOREIGN PATENT DOCUMENTS

| | | |
|---|---|---|
| EP | 0 453 401 | 1/1996 |
| JP | 11-18840 | 5/1989 |
| JP | 10-215952 | 8/1998 |
| JP | 2002-223859 | 8/2002 |
| JP | 2003-180453 | 7/2003 |
| JP | 2003-339446 | 12/2003 |
| JP | 2004-267429 | 9/2004 |
| WO | WO 90/03132 | 4/1990 |
| WO | WO 02/102193 | 12/2002 |
| WO | WO 03/030683 | 4/2003 |

OTHER PUBLICATIONS

Gibraltar, Metal Table Bases and Legs, 2 page printout from web site, Oct. 6, 2005.

Werndl, The Flexible Solution, FlipTop, 4 pages, not dated.

* cited by examiner

FLIP TOP TABLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to flip top tables and more specifically to a table assembly that includes a bracket assembly that uses multiple pins to lock a top member in either of at least a vertical or a horizontal position for storage or use, respectively, and/or where the entire bracket assembly moves with the table top when the top is moved between supported positions.

Many flip top type tables have been developed that include table top members that can be moved between vertical and horizontal positions. However, each known flip type table assembly typically has one or more shortcomings. For example, many table assemblies are configured such that when a top member is restrained in a supported position, the top member may wobble or rock on the supporting structure which can be distracting to a table user. Most table users do not want to use a wobbly table.

As another example, in many cases flip top table assemblies that are designed to reduce or minimize wobble/rocking are relatively complex and require bulky components and/or components that are relatively visible below a table top member which appreciably reduces the aesthetic appeal of the assembly configurations. In addition, where assemblies are complex, the assemblies are often relatively expensive to manufacture and maintain.

As still one other example, many flip top table assemblies are difficult to manipulate. In this regard, in many cases, to release a table top from one of a vertical or a horizontal position for movement to the other of the positions, a table user has to crawl under the table top to access one or more release mechanisms. Similarly, in many cases, once a user moves a table top to a new position, to lock the top in the new position, the user has to perform some affirmative action such as, again, in some cases, accessing the release mechanism and relocking the mechanism. Relocking a release mechanism can be a challenge, especially when components have to be aligned properly (i.e., a pin with a locking aperture) prior to performing locking action.

Thus, it would be advantageous to have a flip top table assembly that has a simple configuration, that is relatively inexpensive to manufacture and maintain, that is simple and easy to operate and that minimizes wobble/rocking of a table top when the top is in a use position.

BRIEF SUMMARY OF THE INVENTION

At least some embodiments of the invention include a flip top table assembly comprising a table top member having an undersurface, a leg member having a top end, a hinge linking the top member to the top end of the leg member for pivotal movement between a substantially horizontal position and a substantially vertical position, a restrainer forming at least first and second openings and forming an edge, a slider forming at least first and second distal pin ends, the slider supported by one of the table top member and the leg member proximate the restraining member and at least a first spring biasing the slider toward the restraining member, wherein, when the table top member is in the substantially horizontal position, the first pin end is substantially aligned with the first opening and is biased by the spring toward a restraining position received within the first opening and, when the table top member is in the substantially vertical position, the second pin end is substantially aligned with the second opening and is biased by the spring toward a restraining position received within the second opening and the first pin end is biased by the spring toward a space adjacent the edge of the restraining member outside the first and second openings.

Some embodiments include a flip top table assembly comprising a table top member having an undersurface, a leg member having a top end and forming at least first and second openings at the top end, a hinge bracket mounted to the undersurface of the top member, a pivot pin mounting the hinge bracket to the top end of the leg member for pivotal motion about a pivot axis between a vertical position and a horizontal position wherein the top member is oriented substantially vertically and substantially horizontally, respectively, a slider forming a pin end, the slider supported by the hinge bracket proximate the top end of the leg member and at least a first spring biasing the pin end toward the top end of the leg member, wherein, the slider and spring move with the hinge bracket and top member when the top member is pivoted between the substantially vertical and substantially horizontal positions, when the table top member is in the substantially horizontal position, the pin end substantially aligned with one of the openings and biased by the spring toward a restraining position received within the aligned opening and, when the table top member is in the substantially vertical position, the pin end substantially aligned with the other of the openings and biased by the spring toward a restraining position received within the other of the openings.

In addition, some embodiments include a table top member having an undersurface, a leg member having a top end and forming first, second and third openings at the top end, a hinge bracket mounted to the undersurface of the top member, a pivot pin mounting the bracket to the top end of the leg member for pivotal motion about a pivot-axis between a vertical position and a horizontal position wherein the top member is oriented substantially vertically and substantially horizontally, respectively, a slider forming first and second pin ends, the slider supported by the hinge bracket proximate the top end of the leg member and at least a first spring biasing the first and second pin ends toward the top end of the leg member, wherein, the slider and spring move with the hinge bracket and top member when the top member is pivoted between the substantially vertical and substantially horizontal positions, when the table top member is in the substantially horizontal position, the first and second pin ends substantially aligned with the first and third openings and biased by the spring toward a restraining position received within the aligned openings and, when the table top member is in the substantially vertical position, the second pin end substantially aligned with the second opening and biased by the spring toward a restraining position received within the second opening.

Furthermore, some embodiments include a flip top table assembly comprising a table top member having an undersurface, first and second leg members having a top ends, first and second hinges linking the top member to the top ends of the first and second leg members, respectively, for pivotal movement between a substantially horizontal position and a substantially vertical position, first and second restrainers, each restrainer forming at least first and second openings and forming an edge, first and second sliders, each slider forming a distal pin end, the first slider supported by one of the table top member and the first leg member proximate the first restraining member, the second slider supported by one of the table top member and the second leg member proximate the second restraining member, first and second springs biasing the first and second sliders toward the first and second restraining members, respectively, first and second handles mounted to the undersurface of the top member and first and second activation cables, each cable including first and second ends, the first ends linked to the first and second sliders and the second ends linked to the first and second handles, respectively, wherein, when the first and second handles are pulled, the sliders move against the force of the first and second springs to released positions wherein the pin ends are removed from the openings, respectively, wherein, when the table top member is in the substantially horizontal position, the pin end formed by the first slider is substantially aligned with one of the openings formed by the first restrainer and is biased by the first spring toward a restraining position received within the aligned opening and the pin end formed by the second slider is substantially aligned with one of the openings formed by the second restrainer and is biased by the second spring toward a restraining position received within the aligned opening and, when the table top member is in the substantially vertical position, the pin end formed by the first slider is substantially aligned with the other of the openings formed by the first restrainer and is biased by the first spring toward a restraining position received within the other opening and the pin end formed by the second slider is substantially aligned with the other of the openings formed by the second restrainer and is biased by the second spring toward a restraining position received within the other opening;

In addition, some embodiments include an apparatus for pivotally mounting a leg member to the undersurface of a of a table top, the apparatus comprising a mounting plate that includes first and second oppositely facing edges, first and second arm members that extend to distal ends substantially perpendicular to the mounting plate and in the same direction from the first and second edges so as to form a leg receiving channel between the first and second arm members, a lateral extension member that extends from and substantially perpendicular to the distal end of the second arm member and away from the first arm member to a distal end and a longitudinal extension member that extends from the distal end of the lateral extension member and substantially perpendicular to the second arm member so as to form a slider receiving channel between the second arm member and the longitudinal extension member.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
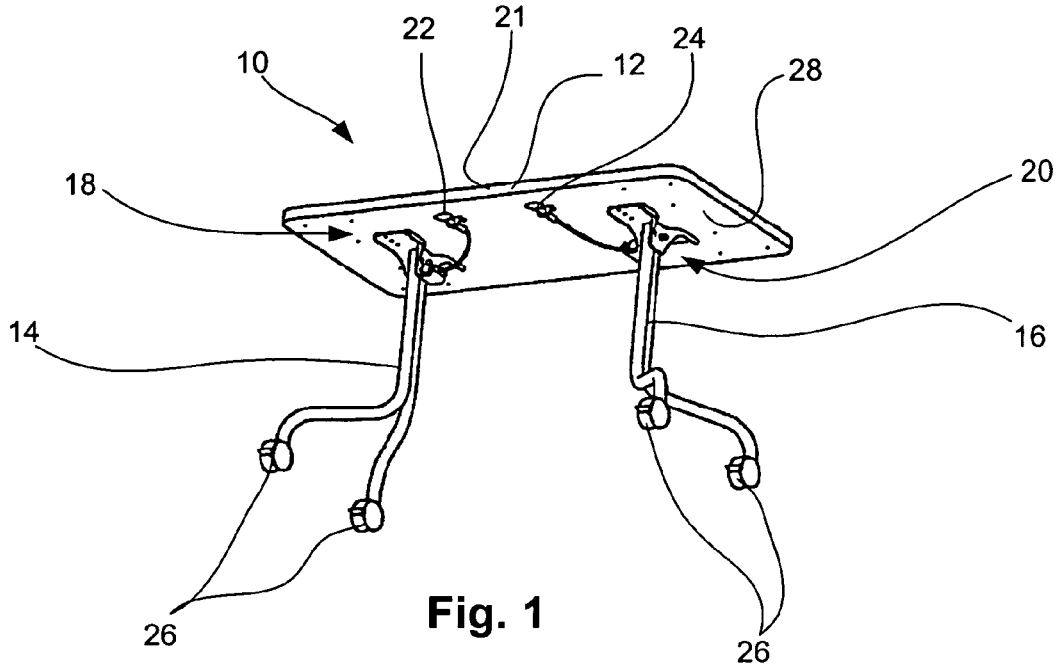
FIG. 1 is a perspective view of an exemplary flip top table assembly according to at least some inventive embodiments with top member in a substantially horizontal use position.

Referring now to the drawings wherein like reference numerals correspond to similar elements throughout the several views and, more specifically, referring to FIGS. 1 through 3, the present invention will be described in the context of an exemplary flip top table assembly 10 that includes a table top member 12, first and second leg assemblies 14 and 16, respectively, and first and second hinge assemblies 18 and 20, respectively, that couple the first and second leg assemblies 14 and 16 to an undersurface 28 of top member 12. First and second handle members 22 and 24, respectively, are linked to the first and second hinge assemblies 18 and 20 via first and second cable assemblies 30 and 32, respectively. When the handles 20 and 24 are pulled, a table user may flip top member 12 from a substantially horizontal position illustrated in FIGS. 1 and 2 to a substantially vertical position illustrated in FIG. 3. When the handles 22 and 24 are released, restrainer and restrainer subassemblies that form part of the hinge assemblies 18 and 20 effectively lock top member 12 in one of the horizontal (see again FIG. 1) or vertical (see again FIG. 3) orientations.

Figure 2:
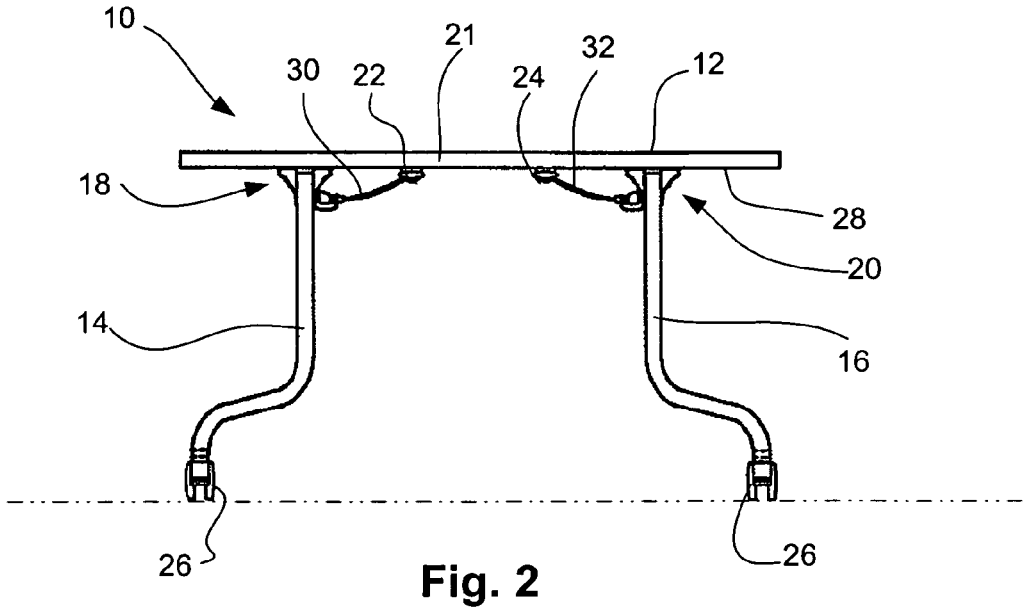
FIG. 2 is a side plan view of the table assembly of FIG. 1.
Figure 3:
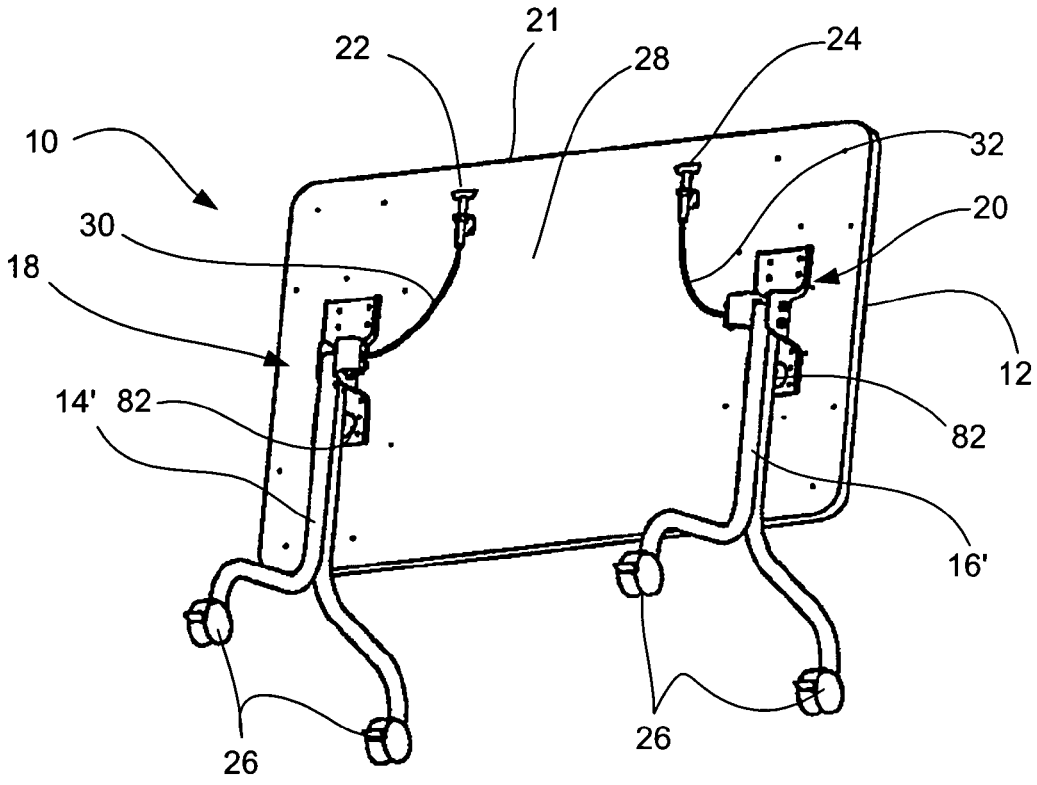
FIG. 3 is a perspective view of a table assembly similar to the assembly of FIG. 1 where the table top member has been moved into a vertical storage position, albeit where the assembly includes leg structure that is different than the leg structure shown in FIG. 1.

Referring still to FIGS. 1 through 3, in FIGS. 1 and 2, a first type of leg subassembly including legs 14 and 16 is illustrated where, as best illustrated in FIG. 2, the legs curve outward near bottom ends away from a space below a central portion of top member 12. In FIG. 3, an alternate embodiment includes leg assemblies 14' and 16' where the components that form each leg assembly are generally juxtaposed within a single plane.

In at least some embodiments, as is illustrated in FIGS. 1 through 3, casters 26 may be provided at lower ends of the leg subassemblies 14 and 16 or assemblies 14' and 16' so that the table assembly 10 can be moved about easily. In other embodiments, caster may not be provided at the lower ends of legs.

Figure 4:
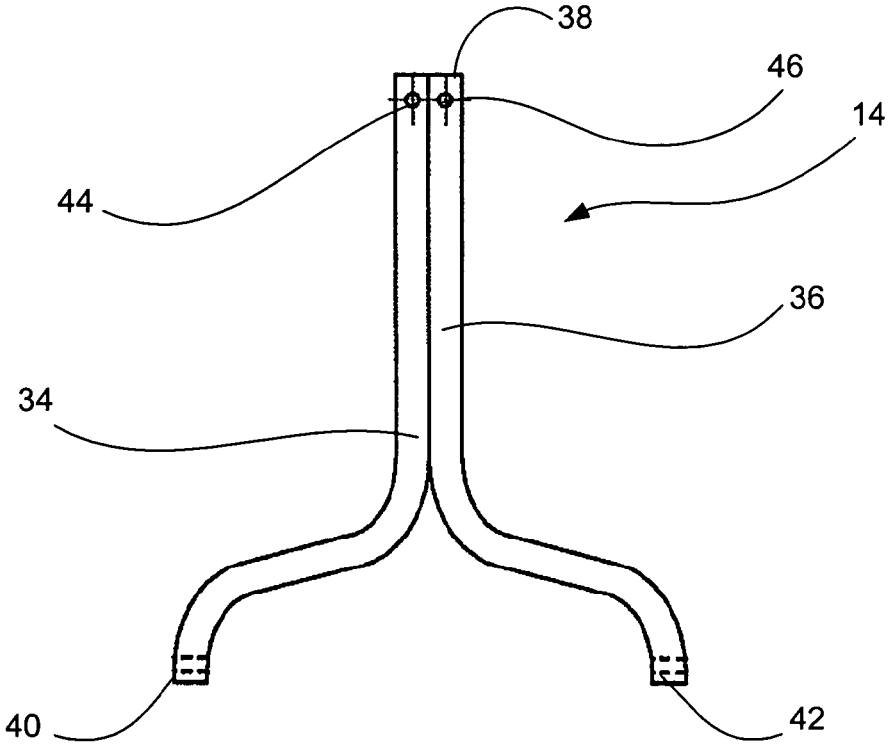
FIG. 4 is a side plan view of an external side of the leg assembly of FIG. 1.
Figure 5:
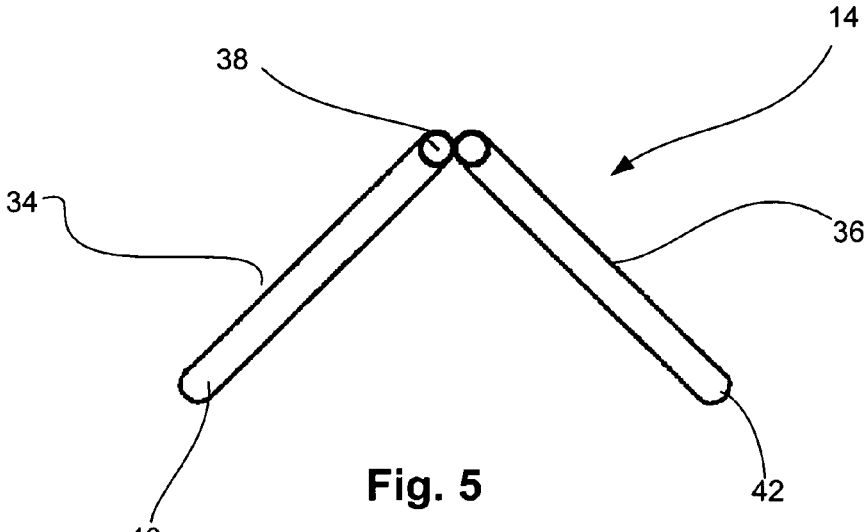
FIG. 5 is a top plan view of the leg assembly of FIG. 4.
Figure 6:
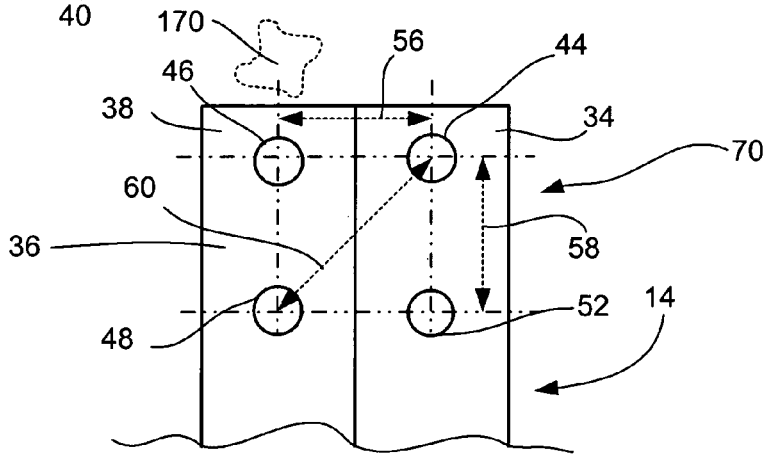
FIG. 6 is an enlarged partial view of an internal side of the leg assembly of FIG. 4.

Referring still to FIGS. 1 and 2, leg assemblies 14 and 16 are similarly constructed and operate in a similar fashion and therefore, in the interest of simplifying this explanation, only assembly 14 will be described here in detail. Referring also to FIGS. 4 through 6, leg assembly 14, in at least some embodiments, may be formed of two rigid metal leg components or pipes 34 and 36 where components 34 and 36 are welded or otherwise fastened together along straight portions thereof adjacent a first or top end 38 of assembly 14. Near the second or bottom end of components 34 and 36, the components 34 and 36 curve outward and then again downward to distal lower ends 40 and 42.

Referring specifically to FIGS. 4 and 6, at the top end 38, leg assembly 14 forms first through fourth openings 48, 46, 52 and 44, respectively, in inner side surfaces of components 34 and 36. In at least some embodiments, openings 44 and 46 extend all the way through components 34 and 36, respectively, while openings 48 and 52 only extend partway through components 36 and 34 (see external side of assembly in FIG. 4 that only includes openings 44 and 46). Thus, for example, where components 34 and 36 are formed of pipe stock, openings 44 and 46 extend through opposite wall sections of the pipe components 34 and 36 while openings 48 and 52 only extend through an inner wall member of the associated members 36 or 34.

Referring still to FIG. 6, openings 48, 46, 52 and 44 generally form a square when viewed head-on. To this end, the dimension 56 between the centers of openings 44 and 46 is identical to the dimension 58 between the centers of openings 44 and 52 which is in turn equal to each of the dimensions between the center of openings 52 and 48 and between openings 48 and 46. A dimension 60 between the centers of openings 44 and 48 is greater than the dimension 56 between the centers of openings 44 and 46. Top end 38 of leg assembly 14, including openings 48, 46, 52 and 44, comprise a restrainer configuration 70.

In at least some embodiments, the radius of each of openings 48 and 52 is identical and the radius of each of openings 46 and 44 is identical and slightly larger than the radius of each of openings 48 and 52.

Referring once again to FIGS. 1 and 2, hinge assemblies 18 and 20 are similarly constructed and operate in a similar fashion and therefore, in the interest of simplifying this explanation, only assembly 18 will be described here in detail. Referring also to FIGS. 7 through 11, hinge assembly 18 includes a bracket component 62, a slider assembly 68 and a pivot pin 64 and associated nut 66. Bracket 62 includes a mounting plate member 99, first and second bracket arms 122 and 114, a lateral extension member 122 and an upward extending member 124. As best seen in FIGS. 8 and 11, mounting plate member 99 is generally flat and has an hour glass shape with two relatively wide portions separated by a reduced width area 98. Plate member 99 forms mounting apertures, two of which are collectively identified by numeral 96 in FIG. 8 that are used to mount plate member 99 to the undersurface (see again 28 in FIG. 1) of table top member 12. To this end, although not illustrated, screws may be provided for mounting plate member 99 to undersurface 28.

Referring still to FIGS. 7 through 11, first and second arm members 112 and 114 extend in the same direction and generally perpendicular to plate member 99 from opposite facing edges of the reduced width area 98. Lateral extension member 22 extends at a generally 90° angle from a distal end of second arm member 114 opposite plate member 99 in a direction generally away from first arm member 112 and is generally parallel to mounting plate member 99. Upward extending member 124 extends generally at a 90° angle from a distal end of lateral extension member 122 and is parallel to and generally opposes a lower portion of arm member 114.

Referring specifically to FIG. 11, second arm member 114 forms first, second, third and fourth holes or openings 126, 92, 128 and 94, respectively, where the first through fourth openings 126, 92, 128 and 94 are arranged to form a square when viewed head-on and are separated by dimensions similar to the dimensions that separate openings 48, 46, 52 and 44 as illustrated in FIG. 6. Openings 92 and 94 have dimensions that are similar to the dimensions of openings 46 and 44, respectively (see again FIG. 6). Openings 126 and 128 have dimensions that are slightly larger than the dimensions of openings 48 and 52 formed at the top end of leg assembly 14. Upward extending member 124 forms first, second and third openings 130, 132 and 134, respectively. Openings 130 and 134 are generally aligned with first and third openings 126 and 128 formed by second arm member 114 and have dimensions that are similar to openings 126 and 128, respectively. Opening 132 is generally smaller than each of openings 130 and 134 and is located between openings 130 and 134 as illustrated.

Figure 9:
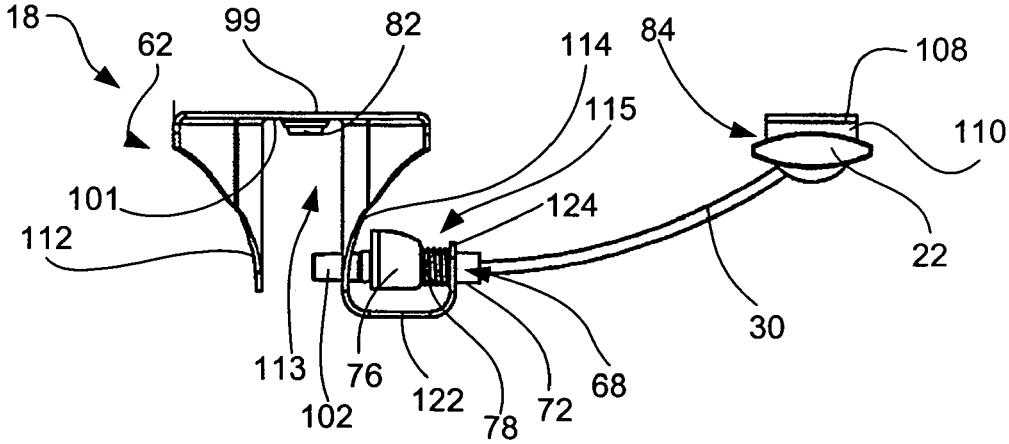
FIG. 9 is a side plan view of the assembly of FIG. 8.

Referring now specifically to FIG. 9, as shown, first and second arm members 112 and 114 are separated and form a leg receiving channel 113 therebetween. In addition, second leg member 114 and upward extending member 124 are separated and form a slider assembly receiving channel 115.

Figure 11:
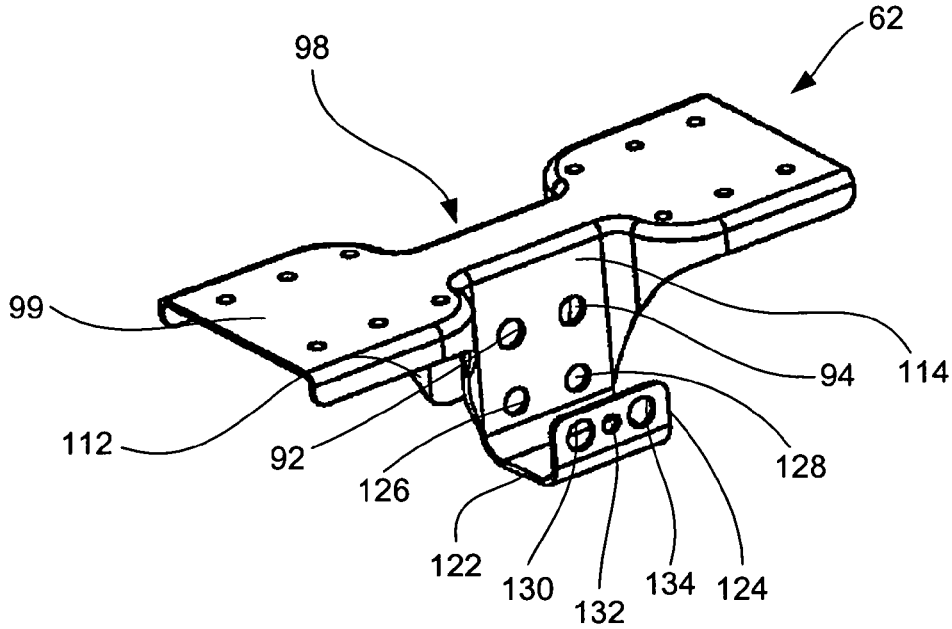
FIG. 11 is a perspective view of the bracket component shown in FIGS. 7 through 9.
Figure 12:
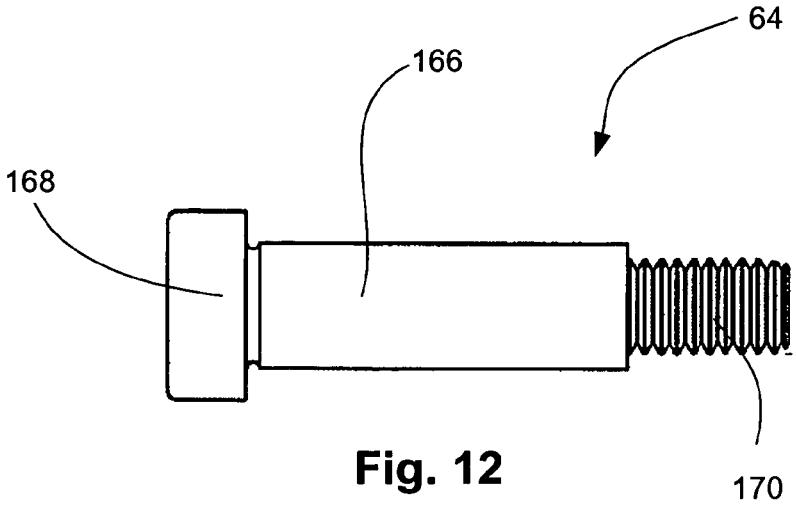
FIG. 12 is a side view of the pivot pin of FIG. 7.

Referring once again to FIG. 7 and also to FIG. 12, pivot pin 64, in at least some embodiments, includes a shoulder screw that has an elongated and smooth cylindrical portion 166 that separates a head member 168 and a threaded distal end 170. Cylindrical portion 166 has a diameter dimension (not labeled) such that it fits snugly within the fourth openings 44 and 94 formed by leg assembly 14 (see FIG. 6) and bracket component 62 (see FIGS. 7 and 11), respectively, and through the opening (not illustrated) that is formed by arm member 112 and that is aligned with opening 94, with a small amount of clearance. In at least some embodiments, head 168 forms a hexagonal recess 69 in a flat end surface thereof for receiving the end of a tightening tool. Nut 66 is dimensioned to received threaded distal end 170 of pin 64.

Figure 7:
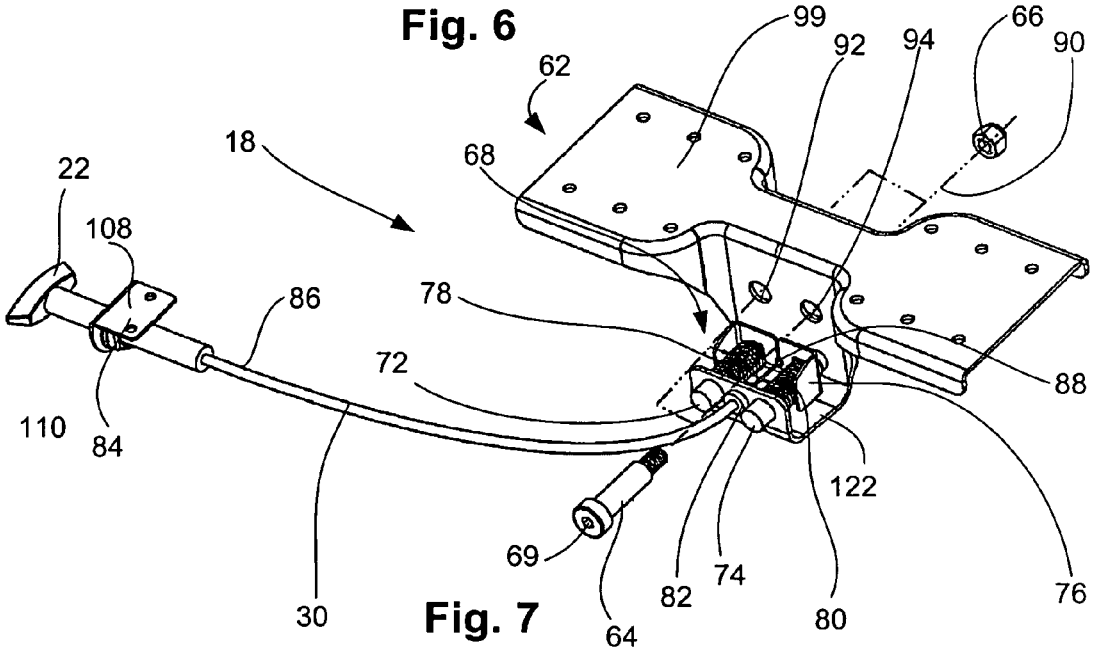
FIG. 7 is a perspective partially exploded view one of the hinge assemblies of FIG. 1.
Figure 8:
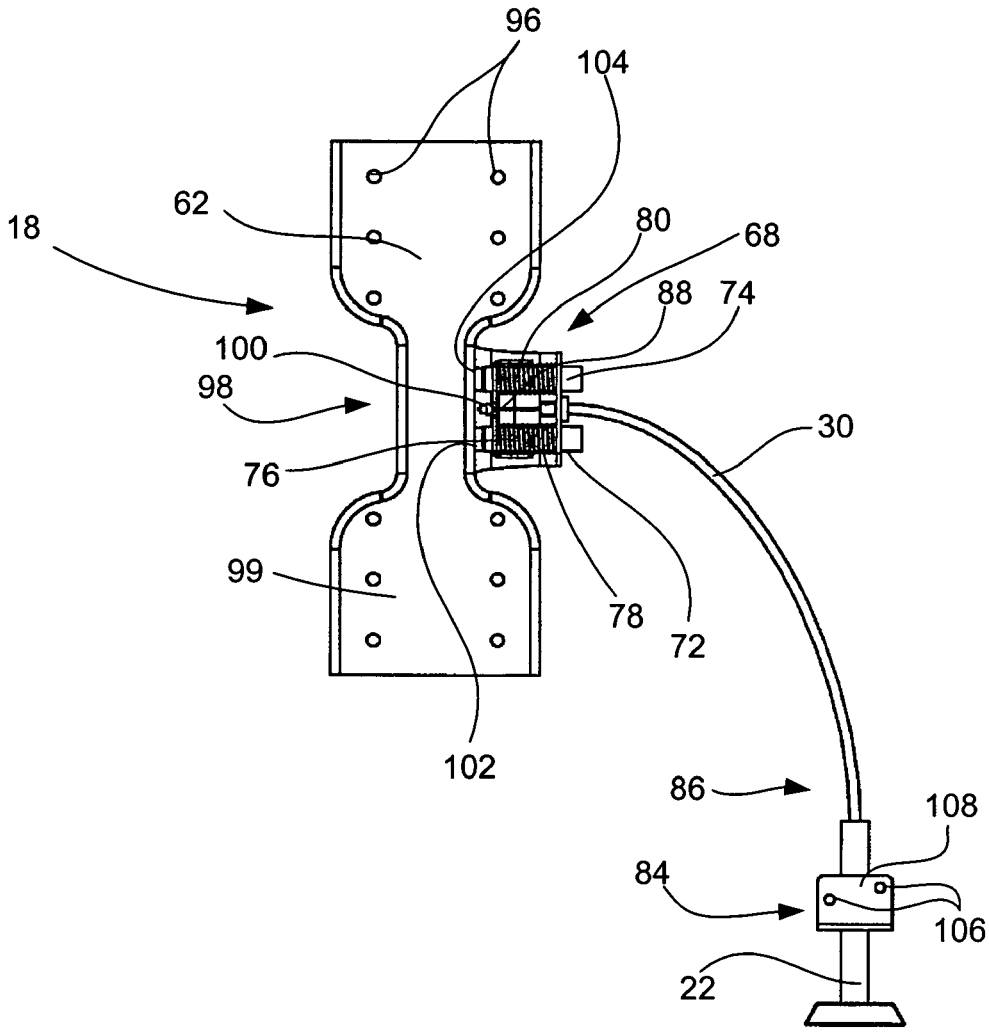
FIG. 8 is a top plan view of the assembly of FIG. 7.

Referring now to FIGS. 7 through 9, slider assembly 68 includes first and second pins 72 and 74, respectively, first and second springs 78 and 80, respectively, and a slider bracket 76. Each of pins 72 and 74 is similarly constructed and operates in a similar fashion and therefore, in the interest of simplifying this explanation, only pin 72 will be described herein detail.

Figure 13:
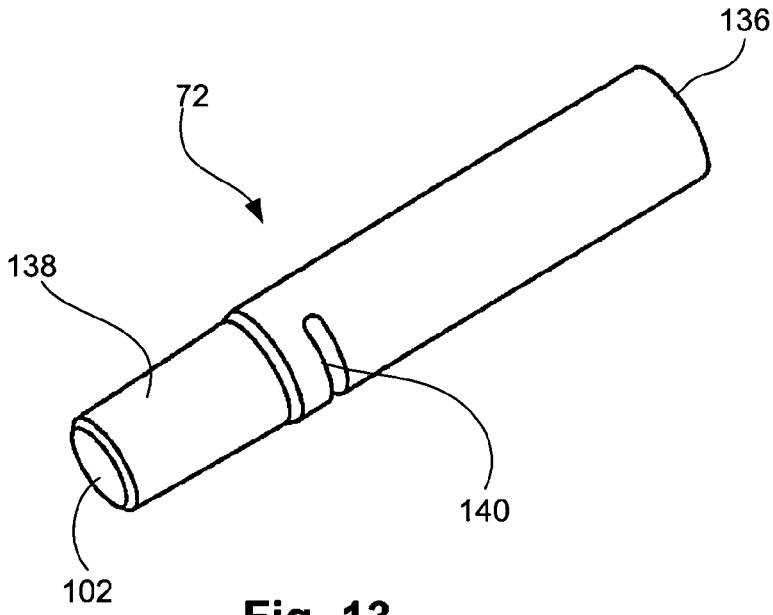
FIG. 13 is a perspective view of one of the pins of FIG. 7.
Figure 14:
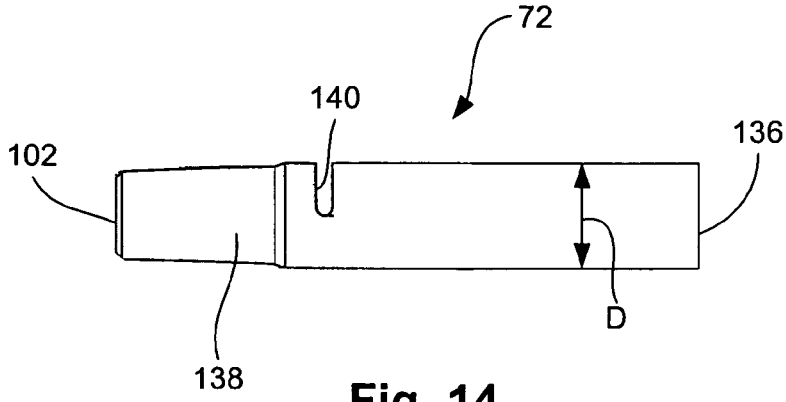
FIG. 14 is a side view of the pin of FIG. 13.

Referring to FIGS. 13 and 14, exemplary pin 72 is an elongated, rigid and, preferably, metallic, cylindrically shaped member that has a proximal end 36 and an oppositely facing distal end 102. Adjacent distal end 102, member 72 forms a ramped or generally frusto-concial surface 138 that tapers to a reduced diameter at end 102. Part way along tapered surface 138, member 72 has a diameter that is equal to the diameter of openings 48 and 52 (see again FIG. 6). Proximate surface 138, member 72 forms a slot 140 cut into a side surface and that extends along a trajectory that is substantially perpendicular to the length of member 72. In the illustrated embodiment, slot 140 extends about half-way through member 72.

Figure 15:
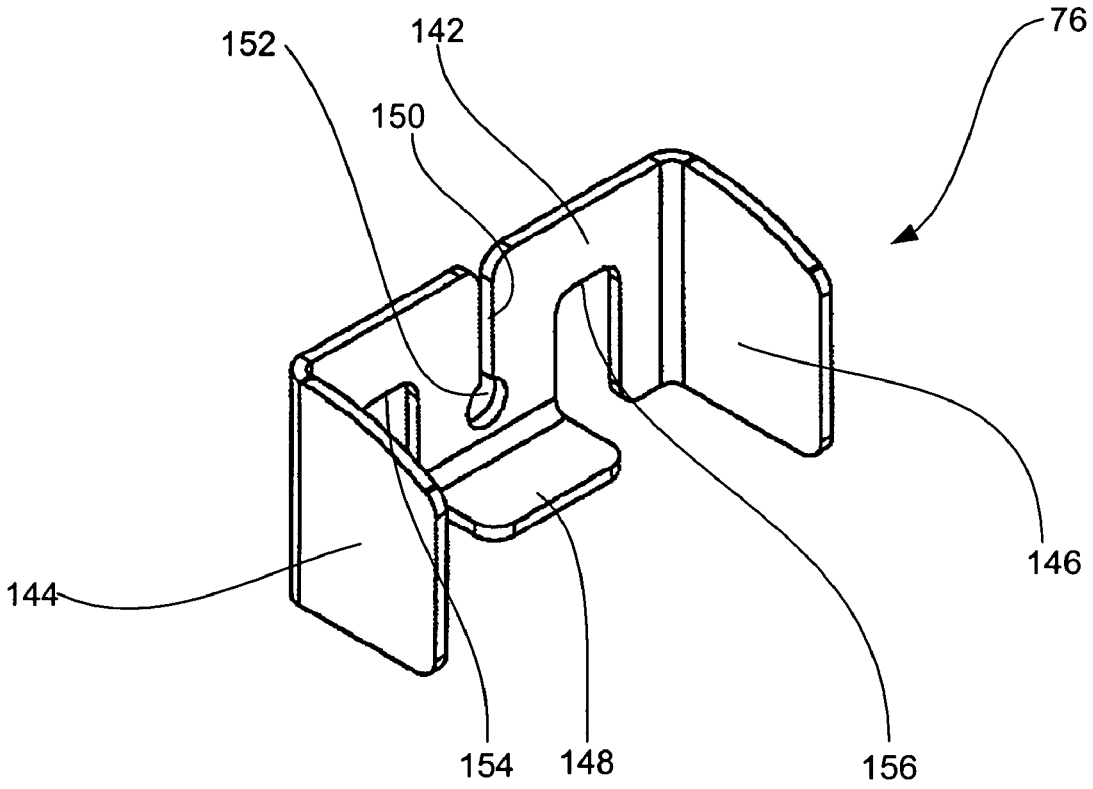
FIG. 15 is a perspective view of the slider bracket of FIG. 7.
Figure 16:
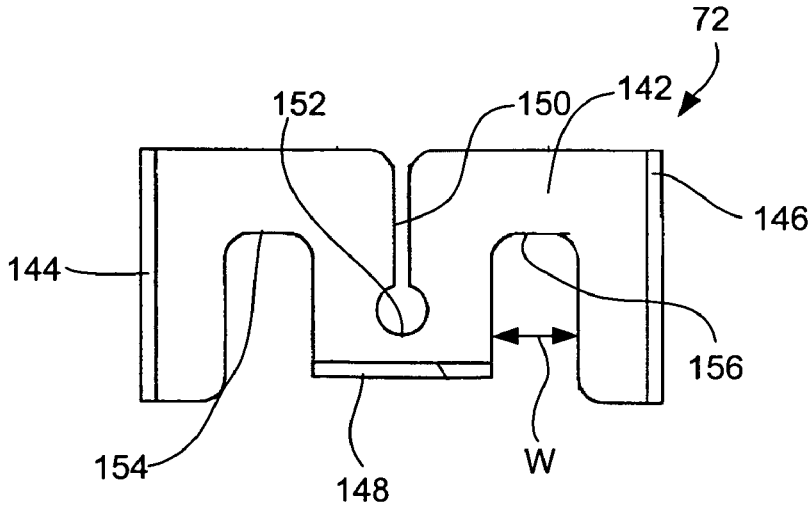
FIG. 16 is a front plan view of the bracket of FIG. 15.

Referring now to FIGS. 7, 15 and 16, slider bracket 76 is a rigid integrally formed member that includes a flat central member 142, first and second arm members 144 and 146 and a tongue member 148. Central member 142 has opposite lateral edges (not labeled) and arm members 144 and 146 extend from the opposite lateral edges to form 90° angles with member 142 and extend in the same direction. Tongue member 148 extends from a lower edge of central member 142 forming a substantially 90° angle therewith and extends in the same direction from member 142 that members 144 and 146 extend. Member 142 forms a cable capture aperture 152 generally centrally between members 144 and 146 and a central slot 150 that opens from a top edge opposite tongue member 148 into capture aperture 152. In addition to slot 150 and aperture 152, member 142 forms first and second pin capture slots 154 and 156, respectively, that open from the lower edge of member 142 and extend partway toward the top edge (i.e., the edge opposite tongue member 148). The internal edges of member 142 that form slots 154 and 156 include portions closest to the top edge that are generally flat. Referring also to FIG. 14, slots 154 and 156 have width dimensions (see W in FIG. 16) that are approximately one-half the diameter dimension D of pin 72. Thus, pin 72 can be turned so that slot 140 faces sideways and can then be slid up into one of the recesses 154 or 156 such that member 72 is generally perpendicular to central member 142.

Figure 17:
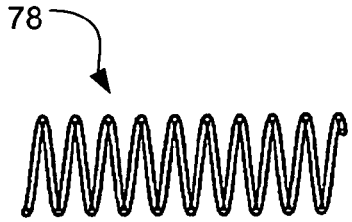
FIG. 17 is a side plan view of one of the springs of FIG. 7.
Figure 18:
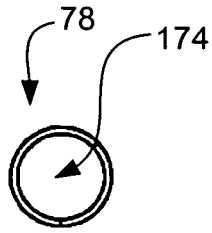
FIG. 18 is an end view of the spring of FIG. 17.

Referring once again to FIG. 7, each of springs 78 and 80 is similarly constructed and operates in a similar fashion and therefore, in the interest of simplifying this explanation, only spring 78 is described here in any detail. Referring also to FIGS. 17 and 18, spring 78 is generally a cylindrical compression spring formed of steel that forms a spring passageway 174.

Figure 10:
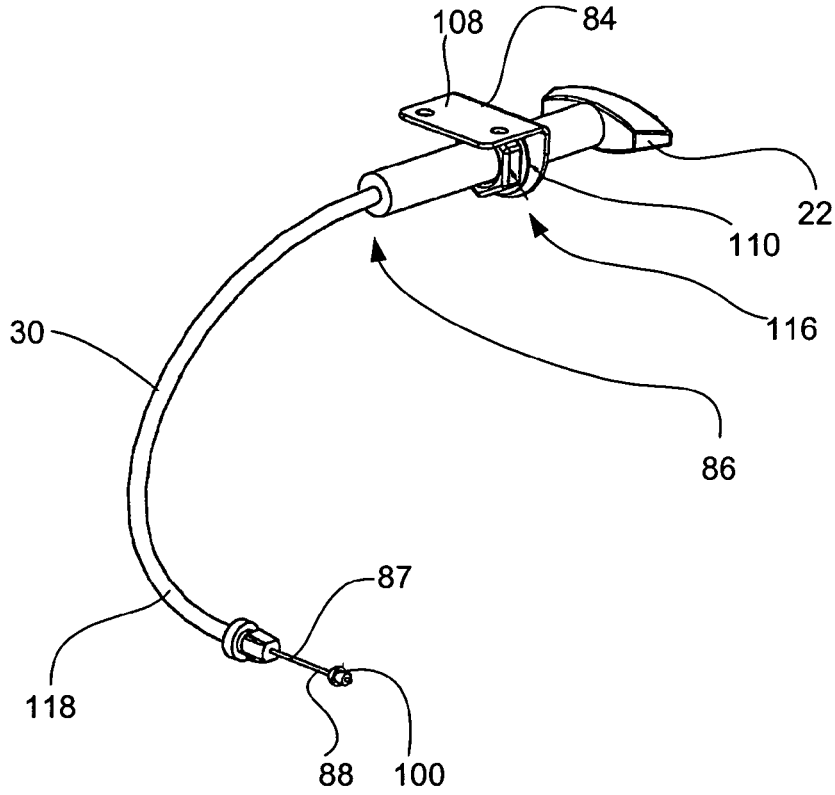
FIG. 10 is a perspective view of a portion of the assembly of FIG. 8.

Referring once again to FIGS. 1 and 2 and also to FIGS. 7 and 10, cable assembly 30 includes a cable 87, a conduit or sheath 30, a sheath stop member 120 and a slug 100. Cable 87 has a first end 88 and a second end identified generally by numeral 86 in FIG. 10 and extends through sheath 118. Slug 100 is secure to first end 88 and a sheath stop member (not labeled) is secured proximate end 88 but separated from slug 100. The second end of cable 87 extends from sheath 118 and is linked to handle member 22. Sheath 118 is formed of a flexible material such as plastic.

Referring to FIGS. 7 through 10, handle bracket 84 is a generally L-shaped bracket member including first and second members 108 and 110, respectively, that are integrally formed and generally form a right angle. First member 108 forms mounting apertures 106 (see FIG. 8) while member 110 forms an opening (not labeled or illustrated) through which the second end 101 of cable 87 extends. A mounting assembly identified generally by numeral 116 mounts the end of sheath 118 adjacent the second end (e.g., 101) of cable 87 to second handle bracket 110.

Figure 19:
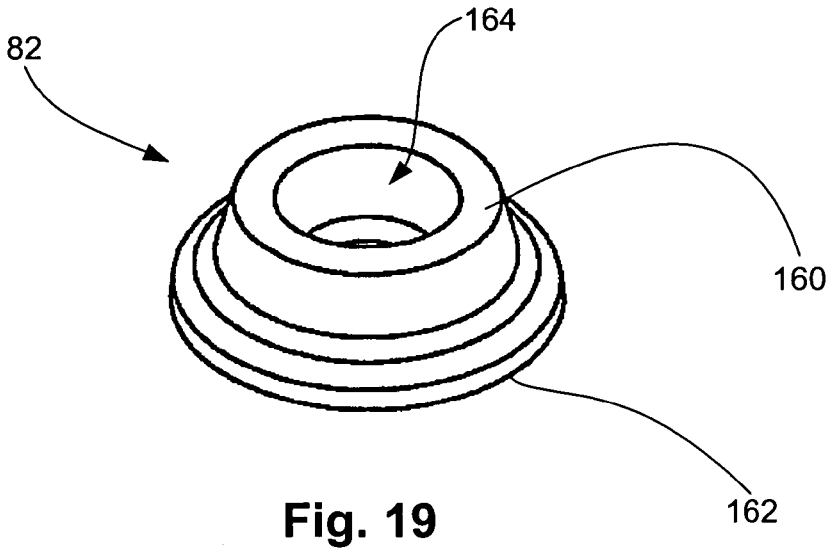
FIG. 19 is a perspective view of a bumper member.

Referring to FIG. 19, a bumper 82 is illustrated that includes a disk shaped member 162 and a frusto-conical central extension member 160 that forms a central recess 164 bumper 82 is formed of rubber. In at least some embodiments the table configuration will include two bumpers.

Figure 20:
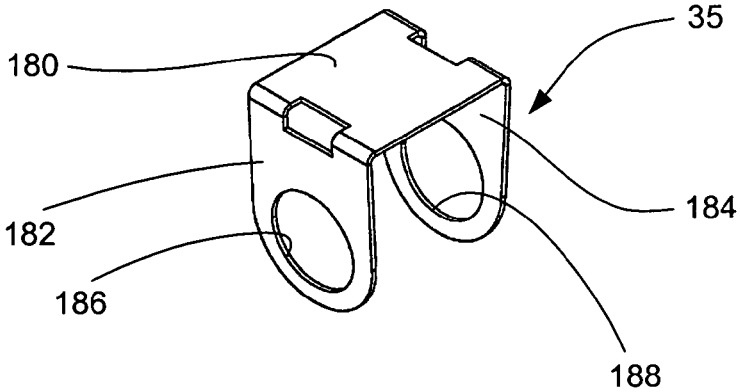
FIG. 20 is a perspective view of a washer member that may be used as a component in at least some table embodiments.

Referring to FIG. 20, a washer member 35 is shown that includes a shoulder member 180 and first and second arm members 182 and 184. Shoulder member 180 is a flat rigid and generally square member. Arm members 182 and 184 extend from opposite edges of member 180 in the same direction and form aligned apertures 186 and 188, respectively and their external (e.g., outward facing) surfaces form a dimension slightly less than the dimension of channel 113 between wall members 112 and 114 (see again FIG. 9).

Referring now to FIGS. 7 through 18, to assemble hinge assembly 18, springs 78 and 80 are positioned within the slider assembly channel 115 such that the spring passageways (see 174 in FIG. 18) are aligned with opening pairs 130, 126 and 134,128 (see FIG. 11), respectively. Pins 72 and 74 are aligned with openings 130 and 134 with the distal ends 102 (see FIG. 13) extending toward the openings 130 and 134 and are then slid through the openings 130 and 134, through the spring passageways 174 and so that the distal ends 102 extend through openings 126 and 128 formed by member 114. Continuing, pins 72 and 74 are rotated such that slots 140 (see again FIG. 13) open generally to opposite sides (e.g., slots 140 open away from each other), springs 78 and 80 are compressed to reveal slots 140 and so that tongue member 148 clears the spring ends when slider bracket 76 is positioned with outside portions of member 142 aligned with pin slots 140, slider bracket 76 is positioned such that the outside portions of member 142 are aligned with slots 140 formed by pins 72 and 74 and then bracket 76 is slid down toward member 122 until outside portions of member 142 mate with slots 154 and 156 and pins 72 and 74 are received in slots 140.

When springs 78 and 80 are released, the springs expand and force bracket 76 toward member 114. Once the spring ends contact member 142, the spring ends lock tongue member 148 in so that slider bracket 76 cannot be removed without re-compressing the springs 78 and 80 to separate the spring ends from member 42.

Referring still to FIGS. 7 through 10 and also to FIGS. 15 and 16, first end 88 of cable 87 is fed through opening 132 formed by member 124 (see again FIG. 11) until slug 100 (see FIG. 10) can be extended past slider bracket 76. At this point, first end 88 of cable 87 can be slid down through slot 150 and generally into the cable capture aperture 152. Next, the second end (generally at 86) of cable 87 can be passed through the opening formed by the second handle bracket member 110 and attached to handle 22 such that the cable 87 is taught between handle 22 and slider bracket 76. In at least some embodiments, cable 87 will have a length dimension such that even when handle 22 is not pulled, the cable 87 will force slider member 76 against the springs 78 and 80 so that the springs are at least partially compressed. At this point, hinge assembly 18 should appear generally as illustrated in FIGS. 7 through 9.

Referring to FIGS. 6 through 9, FIG. 11 and FIG. 20, to mount hinge assembly 18 to the top end of leg assembly 14, washer member 35 is placed with channel 113 so that member 180 is adjacent plate 99 and apertures 186 and 188 are aligned with fourth opening 94 and the other opening (not illustrated) formed by member 112 that is aligned with opening 94. Bracket component 62 is positioned such that leg receiving channel 113 and washer member 35 are aligned with top end 38 and so that the four openings 48, 46, 52 and 44 formed by assembly 14 face in the same direction as the four openings 126, 92, 128 and 94 formed by bracket component 62. Handle 22 can be pulled so that the distal ends 102 of the pins 72 and 74 are pulled out of channel 113 and then bracket component 62 is lowered on to top end 38 until openings 48, 46, 52 and 44 are aligned with openings 126, 92, 128 and 94, respectively. When handle 22 is released, springs 78 and 80 force the distal ends 102 of pins 72 and 74 through openings 126 and 128 and into openings 48 and 52, respectively. Continuing, as best seen in FIG. 7, pin 64 is slid through opening 94 and completely through opening 44 and openings 186 and 188 of washer member 35 so that the distal threaded end (see 170 in FIG. 12) of pin 64 extends from opening 44 on the opposite side of member 34 (see again FIG. 4). Nut 66 is attached to threaded end 170 of pin 64 to secure hinge assembly 18 to top end 38 of leg assembly 14.

Referring now to FIGS. 1, 2, 8 and 9, to mount hinge assembly 18 to table top member 12, mounting plate member 99 is placed against undersurface 28 of top member 12 and screws are fed through mounting apertures 96 and into member 12. Handle bracket 84 is also mounted via screws through mounting apertures 106 to the undersurface 28. In at least some embodiments, handle bracket 84 will be mounted proximate an edge (see 21 in FIGS. 1-3) of top member 12 so that the handle 22 is easily accessible. For example, the bracket 84 may be mounted such that the handle 22 is 1 to 2 inches away from edge 21.

Referring to FIGS. 1 through 3 and FIG. 7, the second leg assembly 16 and hinge assembly 20 are assembled and mounted to the undersurface 28 in a fashion similar to that described above. Here it should be understood that when the second leg and hinge assembly is mounted to undersurface 28, the mounting should be such that the pivot axes (see 90 in FIG. 7) formed by the pivot pins 64 in each of the hinge assemblies 18 and 20 is identical.

Referring to FIG. 3, bumpers 82 can be mounted via adhesive or otherwise to undersurface 101 of bracket components 62 so that when top member 12 is moved into the vertical orientation, impact between the undersurface of top member 12 and the leg assemblies is cushioned.

Referring now to FIGS. 1 through 3 and also to FIGS. 6 through 10, in operation, with top member 12 in a generally horizontal position (see FIGS. 1 and 2), when handles 22 and 24 are released, springs 78 and 80 expand and force pins 72 and 74 along trajectories such that distal ends 102 of the pins 72 and 74 extend into openings 48 and 52, respectively, at the top ends 38 of each of leg assemblies 14 and 16. Here, the dual pin locking or restraining action ensures a relatively stable and tip or wobble free top member 12. To flip the top member 12 up into the vertical position as illustrated in FIG. 3, a table user simply pulls handles 22 and 24 which causes cables 87 to pull against the slider brackets 76 and to compress springs 78 and 80 such that distal ends 102 of pins 72 and 74 are pulled from openings 48 and 52. After pins 72 and 74 have been removed from openings 48 and 52, the only mechanical connection between the hinge assemblies 18 and 20 and the leg assemblies 14 and 16 includes coaxially aligned pins 64 and therefore the table user can freely rotate the top member 12 from the horizontal position up into the vertical storage position shown in FIG. 3. Once top member 12 is in the vertical position as shown in FIG. 3, referring specifically to FIGS. 6 and 7, pin 74 will be aligned with second opening 46 while pin 72 will be aligned with a space 170 adjacent the top end 38 (i.e., pin 72 will be misaligned with respect to the openings at top end 38). When handles 22 and 24 are released, springs 78 and 80 again force the distal ends 102 of pins 72 and 74 through openings 126 and 128 (see again FIG. 11) and force the distal end 102 of pin 74 into opening 46 thereby locking the top member 12 in the vertical position. To reposition top member 12 in the horizontal position, the table user simply pulls handles 22 and 24 again thereby removing pins 74 from openings 46 and then rotates top member 12 into the horizontal orientation.

In the illustrated embodiment, when top member 12 is in an intermediate position (e.g., a position between the vertical and horizontal positions), handles 22 and 24 can be released thereby allowing springs 78 and 80 to expand and the distal ends 102 of pins 72 and 74 to extend and contact the internal surface (see FIG. 6) of leg assembly 14. As the table top 12 is rotated or pivoted, eventually, if table top 12 is moved to the horizontal position, pins 72 and 74 align with openings 48 and 52 and are forced therein automatically upon alignment. Similarly, if the table top is moved to the vertical position, pin 74 aligns with opening 46 and is forced therein automatically to lock the table top in the vertical position.

Thus, it should be appreciated that a relatively simple and inexpensive flip top table assembly 10 has been described. Assembly 10 is not only simple and relatively inexpensive to construct, but it also operates particularly well, especially given the two pin configuration which increases the table top stability when the top member 12 is in the horizontal orientation as shown in FIGS. 1 and 2. In addition, the cable assembly 10 is esthetically pleasing because the restraining or position locking mechanisms are simple and, in generally, can be hidden essentially entirely in the inside sides of leg assemblies where the mechanisms are not very easy to see. Moreover, the dual handle configuration ensures that the top member 12 will not be inadvertently flipped from the horizontal position to the vertical position or visa versa. To this end, both handles 22 and 24 have to be pulled simultaneously in order to release the locking mechanisms. Inadvertent dual handle activation is unlikely.

Another advantage of the inventive embodiment is that each of the two leg assemblies 14, 16 described above is configured so that the assembly can be used as either the right hand or left hand assembly and therefore assembly is less complicated. To this end, referring specifically to FIG. 7, while pin 64 and nut 66 are shown aligned with opening 94 and with handle 22 extending to the left, pin 64 and nut 66 could just as easily be aligned with opening 92 with handle 22 extending to the right to swap the hinge assembly 18 for assembly 20 in FIG. 1.

One or more specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims. For example, while the exemplary embodiment described above includes two pins 72 and 74, in at lease some embodiments a single slider member may be provided that includes, in effect, two extension or pin ends akin the distal pin ends 102. In addition, in at lease some embodiments, it is contemplated that a single spring may suffice.

Moreover, the inventive hinge and restraining configuration described above may be used with many different types of leg assemblies and the invention should not be limited by the leg assemblies described above.

Furthermore, in at lease some cases it is contemplated that the slider assembly 68 may be separately mounted to the undersurface 28 of member 12. In other embodiments it is contemplated that the slider assembly may only include a single pin where the entire locking mechanism moves with the top member 12 when the member 12 is moved from the horizontal position to the vertical position.

Figure 21:
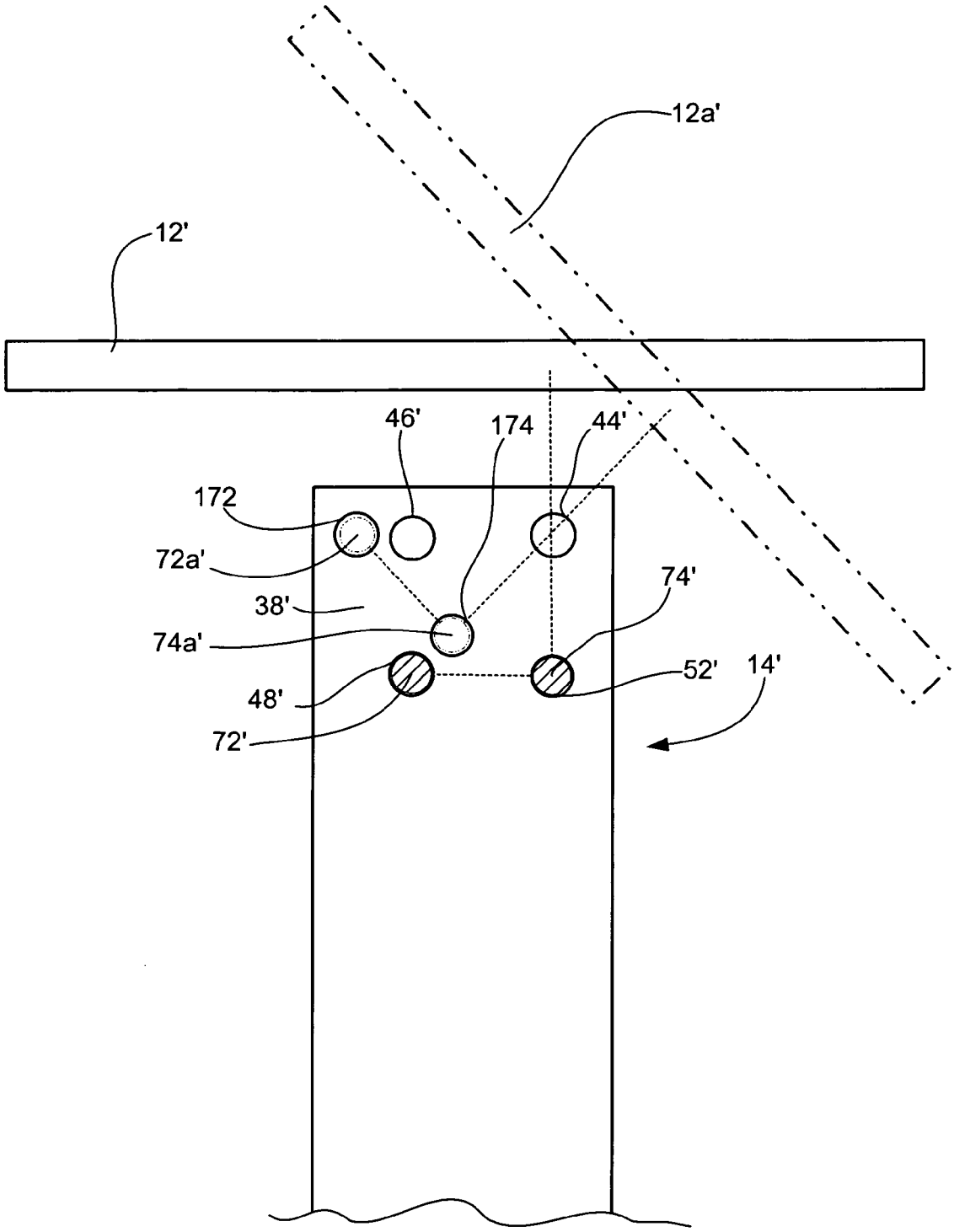
FIG. 21 is a schematic view similar to FIG. 6, albeit illustrating the top end of a leg assembly that can restrain a table top in either a horizontal orientation, a vertical orientation or an intermediate angled orientation.

In addition, although not illustrated, it is contemplated that additional openings may be formed at the top ends of the leg assemblies 14 and 16 so that one or more intermediate table top member positions may be supported. To this end, referring to FIG. 21 a schematic diagram illustrating another embodiment where a table top member 12 is supportable in one intermediate position is shown. In FIG. 21, components and features that are similar to the features described above are identified by the same numeral followed by a "'". For example, label 14 was used to refer to a leg assembly in FIG. 6 and label 14' is used in FIG. 21. Other features in FIG. 21 that are similar to features described above include a top end 38' of leg assembly 14', first through fourth openings 48', 46', 52' and 44' respectively, that are formed at top end 38', table top member 12' and pins 72' and 74' that are shown in cross-section. In addition to forming openings 48', 46', 52' and 44' at top end 38', in FIG. 21, leg assembly also forms a pair of intermediate position openings identified by numerals 172 and 174. In this case, as in the case of the table assemblies described above, when top member 12' is in the horizontal position, distal ends of pins 72' and 74' are received in openings 48' and 52' to restrain or lock top member 12' in the horizontal position. When a user pulls on the handles 22 and 24 (see again FIG. 1) to remove the pins 72' and 74' from openings 48' and 52', the top member can be moved to an intermediate position shown in phantom and labeled 12*a*' in FIG. 21 where the pins are aligned with the intermediate pair of openings 172 and 174. In FIG. 21, the pins are identified by labels 72*a*' and 74*a*' and are shown in phantom in the intermediate position where they are aligned with openings 172 and 174. Here, when the handles 22 and 24 are released, the springs force the distal ends of the pins 72*a*' and 74*a*' into openings 172 and 174 respectively, thereby locking the top 12*a*' in the intermediate position.

Figure 22:
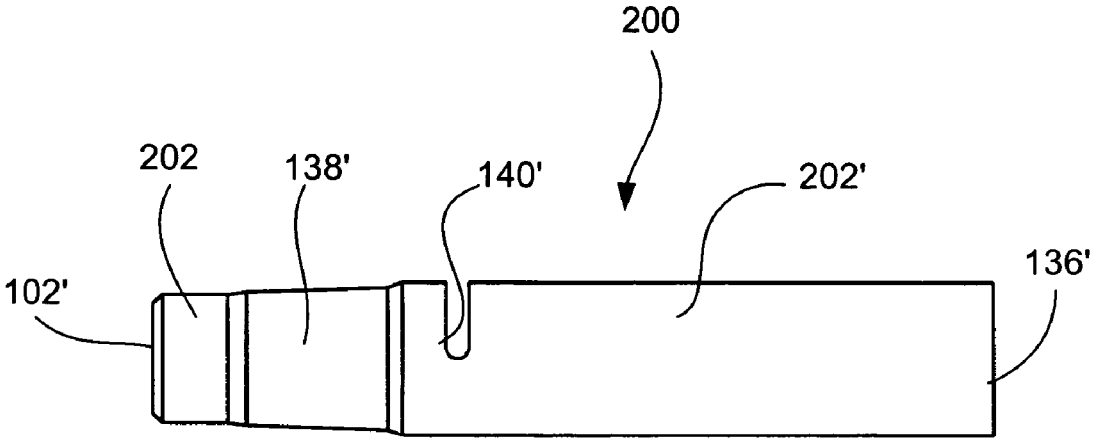
FIG. 22 is similar to FIG. 14, albeit illustrating a second pin type that may be used with at least some flip top tables.

Moreover, other pin designs in addition to the design of pin 72 described above are contemplated. For instance, referring to FIG. 22, another pin 200 is shown that is similar to pin 72 described above with respect to FIG. 14. Similar features between pin 200 and pin 72 are labeled with an identical number in FIG. 22 followed by a "'" and are not again described herein detail.

One primary additional feature of pin 200 is that pin 200 includes an additional cylindrical portion 202 between end 102' and frusto-conical portion 138'. Here, if pin 200 ever begins to slip out of opening formed by a leg member (e.g., when excessive weight is applied at the end of top member 12), the pin slippage will halt or at least be impeded when portion 202 is aligned with the opening.

To apprise the public of the scope of this invention, the following claims are made.

What is claimed is:

1. A flip top table assembly comprising:

a table top member having an undersurface;

a leg member having a top end;

a hinge linking the top member to the top end of the leg member for pivotal movement between a substantially horizontal position and a substantially vertical position;

a restrainer forming at least first and second openings and forming an edge;

a slider forming at least first and second distal pin ends, the slider supported by one of the table top member and the leg member proximate the restraining member;

at least a first spring biasing the slider toward the restrainer;

wherein, when the table top member is in the substantially horizontal position, the first pin end is substantially aligned with the first opening and is biased by the spring toward a restraining position received within the first opening and, when the table top member is in the substantially vertical position, the second pin end is substantially aligned with the second opening and is biased by the spring toward a restraining position received within the second opening and the first pin end is biased by the spring toward a space adjacent the edge of the restrainer outside the first and second openings; and an activator linked to the slider for moving the slider against the force of the spring to a released position wherein the pin ends are displaced from the openings.

2. The assembly of claim 1 wherein the slider includes first and second pins that form the first and second pin ends, respectively.

3. The assembly of claim 2 wherein the spring includes first and second compression springs that form first and second spring passageways, respectively, the first pin extending through the first passageway and the second spring extending through the second passageway.

4. The assembly of claim 1 wherein the distal ends of the pin ends taper.

5. The assembly of claim 1 wherein the activator includes a cable.

6. The assembly of claim 5 wherein the activator further includes a handle and a sheath and the cable includes first and second ends linked to the slider and the handle, respectively, at least a portion of the cable between the first and second ends passing through the sheath.

7. A flip top table assembly comprising:

a table top member having an undersurface;

a leg member having a top end;

a hinge linking the top member to the top end of the leg member for pivotal movement between a substantially horizontal position and a substantially vertical position;

a restrainer forming at least first and second openings and forming an edge;

a slider forming at least first and second distal pin ends, the slider supported by one of the table top member and the leg member proximate the restrainer;

at least a first spring biasing the slider toward the restrainer, wherein the slider includes first and second pins that form the first and second pin ends, respectively;

wherein, when the table top member is in the substantially horizontal position, the first pin end is substantially aligned with the first opening and is biased by the spring toward a restraining position received within the first opening and, when the table top member is in the substantially vertical position, the second pin end is substantially aligned with the second opening and is biased by the spring toward a restraining position received within the second opening and the first pin end is biased by the spring toward a space adjacent the edge of the restrainer outside the first and second openings; and an activation cable wherein the slider further includes a slider bracket that forms first and second openings, the first and second pins passing through the first and second openings, respectively, the activation cable linked at one end to the slider bracket.

8. The assembly of claim 7 further including a hinge bracket mounted to the undersurface of the top member, the slider supported by the hinge bracket with the spring positioned between the hinge bracket and the slider bracket.

9. The assembly of claim 8 wherein the hinge and the hinge bracket are integrally formed.

10. A flip top table assembly comprising:

a table top member having an undersurface;

a leg member having a top end;

a hinge linking the top member to the top end of the leg member for pivotal movement between a substantially horizontal position and a substantially vertical position;

a restrainer forming at least first and second openings and forming an edge;

a slider forming at least first and second distal pin ends, the slider supported by one of the table top member and the leg member proximate the restrainer;

at least a first spring biasing the slider toward the restrainer;

wherein, when the table top member is in the substantially horizontal position, the first pin end is substantially aligned with the first opening and is biased by the spring toward a restraining position received within the first opening and, when the table top member is in the substantially vertical position, the second pin end is substantially aligned with the second opening and is biased by the spring toward a restraining position received within the second opening and the first pin end is biased by the spring toward a space adjacent the edge of the restrainer outside the first and second openings; and wherein the restrainer forms a third opening and, wherein, when the top member is in the substantially horizontal position, the second pin end is substantially aligned with the third opening and is biased by the spring toward a restraining position received within the third opening.

11. A flip top table assembly comprising:

a table top member having an undersurface;

a leg member having a top end;

a hinge linking the top member to the top end of the leg member for pivotal movement between a substantially horizontal position and a substantially vertical position;

a restrainer forming at least first and second openings and forming an edge;

a slider forming at least first and second distal pin ends, the slider supported by one of the table top member and the leg member proximate the restrainer;

at least a first spring biasing the slider toward the restrainer;

wherein, when the table top member is in the substantially horizontal position, the first pin end is substantially aligned with the first opening and is biased by the spring toward a restraining position received within the first opening and, when the table top member is in the substantially vertical position, the second pin end is substantially aligned with the second opening and is biased by the spring toward a restraining position received within the second opening and the first pin end is biased by the spring toward a space adjacent the edge of the restrainer outside the first and second openings; and wherein the top end of the leg member forms the restrainer and the slider is supported by the undersurface of the top member.

12. The assembly of claim 11 further including a hinge bracket mounted to the undersurface of the top member, the slider supported by the hinge bracket.

13. The assembly of claim 12 wherein the hinge and the hinge bracket are integrally formed.

14. A flip top table assembly comprising:

a table top member having an undersurface;

a leg member having a top end and forming at least first and second openings at the top end;

a hinge bracket mounted to the undersurface of the top member;

a pivot pin mounting the hinge bracket to the top end of the leg member for pivotal motion about a pivot axis between a vertical position and a horizontal position wherein the top member is oriented substantially vertically and substantially horizontally, respectively;

a slider forming a pin end, the slider supported by the hinge bracket proximate the top end of the leg member; and at least a first spring biasing the pin end toward the top end of the leg member;

wherein, the slider and spring move with the hinge bracket and top member when the top member is pivoted between the substantially vertical and substantially horizontal positions, when the table top member is in the substantially horizontal position, the pin end substantially aligned with one of the openings and biased by the spring toward a restraining position received within the aligned opening and, when the table top member is in the substantially vertical position, the pin end substantially aligned with the other of the openings and biased by the spring toward a restraining position received within the other of the opening; and wherein the top end of the leg member forms first, second and third openings where the one of the openings is the third opening and the other of the openings is the second opening, and wherein a second pin end is substantially aligned with the first opening and is biased by the spring toward a restraining position received within the first opening when the top member is in the substantially horizontal position.

15. The assembly of claim 14 wherein the slider includes first and second pins that each pin includes a distal pin end and wherein the spring biases each of the first and second pin distal ends toward the top end of the leg member.

16. The assembly of claim 15 further including a second spring wherein each of the springs is a compression spring that that forms a spring passageway, the first pin extending through the passageway formed by the first spring and the second pin extending through the passageway formed by the second spring.

17. The assembly of claim 14 wherein the first opening is horizontally at the same level as the third opening.

18. The assembly of claim 14 wherein the first opening is spaced away from the pivot axis a greater distance than the first opening.

19. The assembly of claim 14 wherein the first and second openings are equi-spaced from the pivot axis.

20. The assembly of claim 19 wherein the first opening is formed below the pivot axis and the second opening is formed to the side of the pivot axis.

21. The assembly of claim 14 wherein an activation cable is linked at one end to the slider for moving the slider against the force of the spring to a released position where the pin end is removed from the openings.

22. A flip top table assembly comprising:

a table top member having an undersurface;

a leg member having a top end and forming at least first and second openings at the top end;

a hinge bracket mounted to the undersurface of the top member;

a pivot pin mounting the hinge bracket to the top end of the leg member for pivotal motion about a pivot axis between a vertical position and a horizontal position wherein the top member is oriented substantially vertically and substantially horizontally, respectively;

a slider forming a pin end, the slider supported by the hinge bracket proximate the top end of the leg member; and at least a first spring biasing the pin end toward the top end of the leg member;

wherein, the slider and spring move with the hinge bracket and top member when the top member is pivoted between the substantially vertical and substantially horizontal positions, when the table top member is in the substantially horizontal position, the pin end substantially aligned with one of the openings and biased by the spring toward a restraining position received within the aligned opening and, when the table top member is in the substantially vertical position, the pin end substantially aligned with the other of the openings and biased by the spring toward a restraining position received within the other of the openings; and a second spring wherein each of the springs is a compression spring that that forms a spring passageway, the first pin extending through the passageway formed by the first spring and the second pin extending through the passageway formed by the second spring; and an activation cable wherein the slider further includes a slider bracket that forms first and second openings and that is supported by the hinge bracket, the first and second pins passing through the first and second openings, respectively, the activation cable linked at one end to the hinge bracket.

23. A flip top table assembly comprising:

a table top member having an undersurface;

a leg member having a top end and forming first, second and third openings at the top end;

a hinge bracket mounted to the undersurface of the top member;

a pivot pin mounting the bracket to the top end of the leg member for pivotal motion about a pivot axis between a vertical position and a horizontal position wherein the top member is oriented substantially vertically and substantially horizontally, respectively;

a slider forming first and second pin ends, the slider supported by the hinge bracket proximate the top end of the leg member; and at least a first spring biasing the first and second pin ends toward the top end of the leg member;

wherein, the slider and spring move with the hinge bracket and top member when the top member is pivoted between the substantially vertical and substantially horizontal positions, when the table top member is in the substantially horizontal position, the first and second pin ends substantially aligned with the first and third openings and biased by the spring toward a restraining position received within the aligned openings and, when the table top member is in the substantially vertical position, the second pin end substantially aligned with the second opening and biased by the spring toward a restraining position received within the second opening.

24. The assembly of claim 23 wherein the leg member forms a fourth opening at the top end, the pivot post passing through the fourth opening and wherein the second and third openings are equi-spaced from the fourth opening and wherein the distance between the first and fourth openings is greater than the distance between the second and fourth openings.

25. The assembly of claim 24 wherein the slider includes first and second separate pins that form the first and second pin ends, respectively.

26. The assembly of claim 25 further including a second spring wherein each of the springs is a compression spring forming a spring passageway and wherein the first and second pins pass through the passageways formed by the first and second springs, respectively.

27. The assembly of claim 23 further including an activation cable linked at one end to the slider for moving the slider to a release position in which the pin ends are removed from the openings.

28. The assembly of claim 27 wherein a second end of the cable is linked to a handle that is mounted to the undersurface of the top member adjacent and edge of the top member.

29. A flip top table assembly comprising:

a table top member having an undersurface;

first and second leg members having a top ends;

first and second hinges linking the top member to the top ends of the first and second leg members, respectively, for pivotal movement between a substantially horizontal position and a substantially vertical position;

first and second restrainers, each restrainer forming at least first and second openings and forming an edge;

first and second sliders, each slider forming a distal pin end, the first slider supported by one of the table top member and the first leg member proximate the first restrainer, the second slider supported by one of the table top member and the second leg member proximate the second restrainer;

first and second springs biasing the first and second sliders toward the first and second restrainer, respectively;

first and second handles mounted to the undersurface of the top member; and first and second activation cables, each cable including first and second ends, the first ends linked to the first and second sliders and the second ends linked to the first and second handles, respectively, wherein, when the first and second handles are pulled, the sliders move against the force of the first and second springs to released positions wherein the pin ends are removed from the openings, respectively;

wherein, when the table top member is in the substantially horizontal position, the pin end formed by the first slider is substantially aligned with one of the openings formed by the first restrainer and is biased by the first spring toward a restraining position received within the aligned opening and the pin end formed by the second slider is substantially aligned with one of the openings formed by the second restrainer and is biased by the second spring toward a restraining position received within the aligned opening and, when the table top member is in the substantially vertical position, the pin end formed by the first slider is substantially aligned with the other of the openings formed by the first restrainer and is biased by the first spring toward a restraining position received within the other opening and the pin end formed by the second slider is substantially aligned with the other of the openings formed by the second restrainer and is biased by the second spring toward a restraining position received within the other opening.

30. The assembly of claim 29 wherein the first and second hinges form first and second integral hinge brackets, the first and second sliders are supported by the first and second hinge brackets and the first and second leg members form the first and second restrainers, respectively.

* * * * *